US007392791B2

(12) United States Patent
Gibson

(10) Patent No.: US 7,392,791 B2
(45) Date of Patent: Jul. 1, 2008

(54) MULTI-SOURCE FUEL SYSTEM FOR VARIABLE PRESSURE INJECTION

(75) Inventor: Dennis H. Gibson, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/443,312

(22) Filed: May 31, 2006

(65) Prior Publication Data

US 2007/0277783 A1 Dec. 6, 2007

(51) Int. Cl.
*F02M 37/04* (2006.01)

(52) U.S. Cl. ..... 123/447; 123/446; 123/456

(58) Field of Classification Search ..... 123/446, 123/456, 506, 496, 447, 500, 501, 299, 300
See application file for complete search history.

(56) References Cited

U.S. PATENT DOCUMENTS 3,000,319 A 9/1961 Tuck
3,105,441 A 10/1963 Grill et al.
4,083,345 A 4/1978 Davis
4,338,231 A 7/1982 Marzocchi et al.
5,094,216 A 3/1992 Miyaki et al.
5,277,156 A 1/1994 Osuka et al.
5,404,855 A 4/1995 Yen et al.
5,433,182 A 7/1995 Augustin et al.
5,441,027 A 8/1995 Buchanon et al.
5,460,133 A 10/1995 Perr et al.
5,592,968 A 1/1997 Nakashima et al.
5,603,303 A 2/1997 Okajima et al.
5,622,152 A * 4/1997 Ishida ..... 123/446
5,642,714 A 7/1997 Buckley
5,727,525 A 3/1998 Tsuzuki
5,732,679 A 3/1998 Takahasi et al.
5,983,863 A 11/1999 Cavanagh et al.
6,092,509 A * 7/2000 Tanabe et al. ..... 123/447
6,095,118 A 8/2000 Klinger et al.

(Continued)

FOREIGN PATENT DOCUMENTS

DE 199 45 673 A1 4/2001

(Continued)

OTHER PUBLICATIONS

B. Mahr (Robert Bosch GmbH, Diesel Systems, DS-NF/SBN, Postfach 30 02 20, D-70469 Stuttgart, Germany), "Future and Potential of Diesel Injection Systems", THIESEL 2002 Conference on Thermo- and Fluid-Dynamic Process in Diesel Engines, Sep. 2002, pp. 5-17, Valencia, Spain.

(Continued)

*Primary Examiner*—Carl S. Miller
(74) *Attorney, Agent, or Firm*—Finnegan, Henderson, Farabow, Garrett & Dunner

(57) ABSTRACT

A fuel system for an engine is disclosed. The fuel system has a first source configured to pressurized fuel to a first pressure, and a second source configured to pressurized fuel to a second pressure. The fuel system also has a fuel injector configured to receive fuel at the first pressure and the second pressure, and a valve disposed between the fuel injector and the first and second sources. The valve is configured to modify the pressure of fuel from the first source based on a pressure of fuel from the second source.

17 Claims, 2 Drawing Sheets

U.S. PATENT DOCUMENTS

| | | | | |
|---|---|---|---|---|
| 6,112,721 | A | 9/2000 | Kouketsu et al. | |
| 6,253,735 | B1 | 7/2001 | Miyajima | |
| 6,311,674 | B1 | 11/2001 | Igashira et al. | |
| 6,357,421 | B1 | 3/2002 | Pritchard | |
| 6,427,660 | B1 | 8/2002 | Yang | |
| 6,491,017 | B1 | 12/2002 | Mahr et al. | |
| 6,505,608 | B2 | 1/2003 | Hiraku et al. | |
| 6,520,152 | B1 | 2/2003 | Mahr et al. | |
| 6,619,263 | B1 | 9/2003 | Otterbach et al. | |
| 6,684,855 | B2 * | 2/2004 | Murakami et al. | 123/446 |
| 6,792,919 | B2 | 9/2004 | Kohketsu et al. | |
| 6,832,599 | B2 * | 12/2004 | Ibrahim et al. | 123/456 |
| 6,889,656 | B1 * | 5/2005 | Rembold et al. | 123/446 |
| 6,895,937 | B2 | 5/2005 | Namekawa et al. | |
| 6,899,084 | B2 * | 5/2005 | Miyashita | 123/446 |
| 6,973,921 | B2 | 12/2005 | Shafer et al. | |
| 7,146,963 | B2 | 12/2006 | Tahara | |
| 7,150,268 | B2 * | 12/2006 | Shafer et al. | 123/446 |
| 7,179,060 | B2 * | 2/2007 | Sommars et al. | 417/53 |
| 7,182,067 | B2 * | 2/2007 | Ricco et al. | 123/446 |
| 2004/0163626 | A1 | 8/2004 | Stockner et al. | |
| 2004/0168673 | A1 | 9/2004 | Shinogle | |
| 2005/0115544 | A1 | 6/2005 | Kim | |
| 2005/0126545 | A1 | 6/2005 | Shafer et al. | |
| 2007/0101968 | A1 | 5/2007 | Gibson et al. | |

FOREIGN PATENT DOCUMENTS

| | | | |
|---|---|---|---|
| EP | 0 643 221 | B1 | 4/1998 |
| EP | 1 273 797 | A2 | 1/2003 |
| EP | 1389680 | A2 | 2/2004 |
| EP | 1 522 719 | A1 | 4/2005 |
| JP | 6-93936 | | 4/1994 |
| WO | WO 01/24320 | A1 | 4/2001 |
| WO | WO 2007/055805 | A1 | 5/2007 |

OTHER PUBLICATIONS

Research Disclosure, Nov. 2004, No. 487, www.researchdisclosure.com, Kenneth Mason Publications Ltd.; Westbourne, Hampshire, UK.

PCT International Search Report, PCT/US2006/036727; Filing Date: Sep. 20, 2006: Applicant: Caterpillar Inc., Date of Mailing Jan. 22, 2007.

PCT International Search Report for PCT/US2007/012029 mailed Dec. 7, 2007.

* cited by examiner

MULTI-SOURCE FUEL SYSTEM FOR VARIABLE PRESSURE INJECTION

TECHNICAL FIELD

The present disclosure is directed to a fuel system and, more particularly, to a fuel system having multiple sources of pressurized fuel for providing variable pressure injection events.

BACKGROUND

Common rail fuel systems provide a way to introduce fuel into the combustion chambers of an engine. Typical common rail fuel systems include an injector having an actuating solenoid that opens a fuel nozzle when the solenoid is energized. Fuel is then injected into the combustion chamber as a function of the time period during which the solenoid remains energized and the pressure of fuel supplied to the fuel injector nozzle during that time period.

To optimize engine performance and exhaust emissions, engine manufacturers may vary the pressure of the fuel supplied to the fuel injector nozzle. One such example is described in U.S. Patent Application Publication No. 2004/0168673 (the '673 publication) by Shinogle published Sep. 2, 2004. The '673 publication describes a fuel system having a fuel injector fluidly connectable to a first common rail holding a supply of fuel, and a second common rail holding a supply of actuation fluid (e.g., oil). Each fuel injector of the '673 patent is equipped with an intensifier piston movable by the actuation fluid to increase the pressure of the fuel. By fluidly connecting the fuel injector to the first common rail, fuel can be injected at a first pressure. By fluidly connecting the fuel injector to the first and second common rails, fuel can be injected at a second pressure that is higher than the first pressure.

Although the fuel injection system of the '673 publication may adequately supply fuel to an engine at different pressures, it may be limited and problematic. Specifically, because the fuel injection system of the '673 publication can inject fuel at only two different pressures, it may be limited from some applications. In addition, because the system utilizes two different fluids, namely fuel and oil, care must be take not to contaminate one fluid with the other. If contamination does occur, the engine may not operate as desired and could possibly suffer damage.

The fuel system of the present disclosure solves one or more of the problems set forth above.

SUMMARY OF THE INVENTION

One aspect of the present disclosure is directed to a fuel system for an engine. The fuel system includes a first source configured to pressurize fuel to a first pressure, and a second source configured to pressurize fuel to a second pressure. The fuel system also includes a fuel injector configured to receive fuel at the first pressure and the second pressure, and a valve disposed between the fuel injector and the first and second sources. The valve is configured to modify the pressure of fuel from the first source based on a pressure of fuel from the second source.

Another aspect of the present disclosure is directed to a method of injecting fuel. The method includes pressurizing a first fuel stream, and pressurizing a second fuel stream. The method also includes modifying the pressure of the first fuel stream based on a pressure of the second fuel stream, and injecting the first fuel stream at the modified pressure.

DETAILED DESCRIPTION

Figure 1:
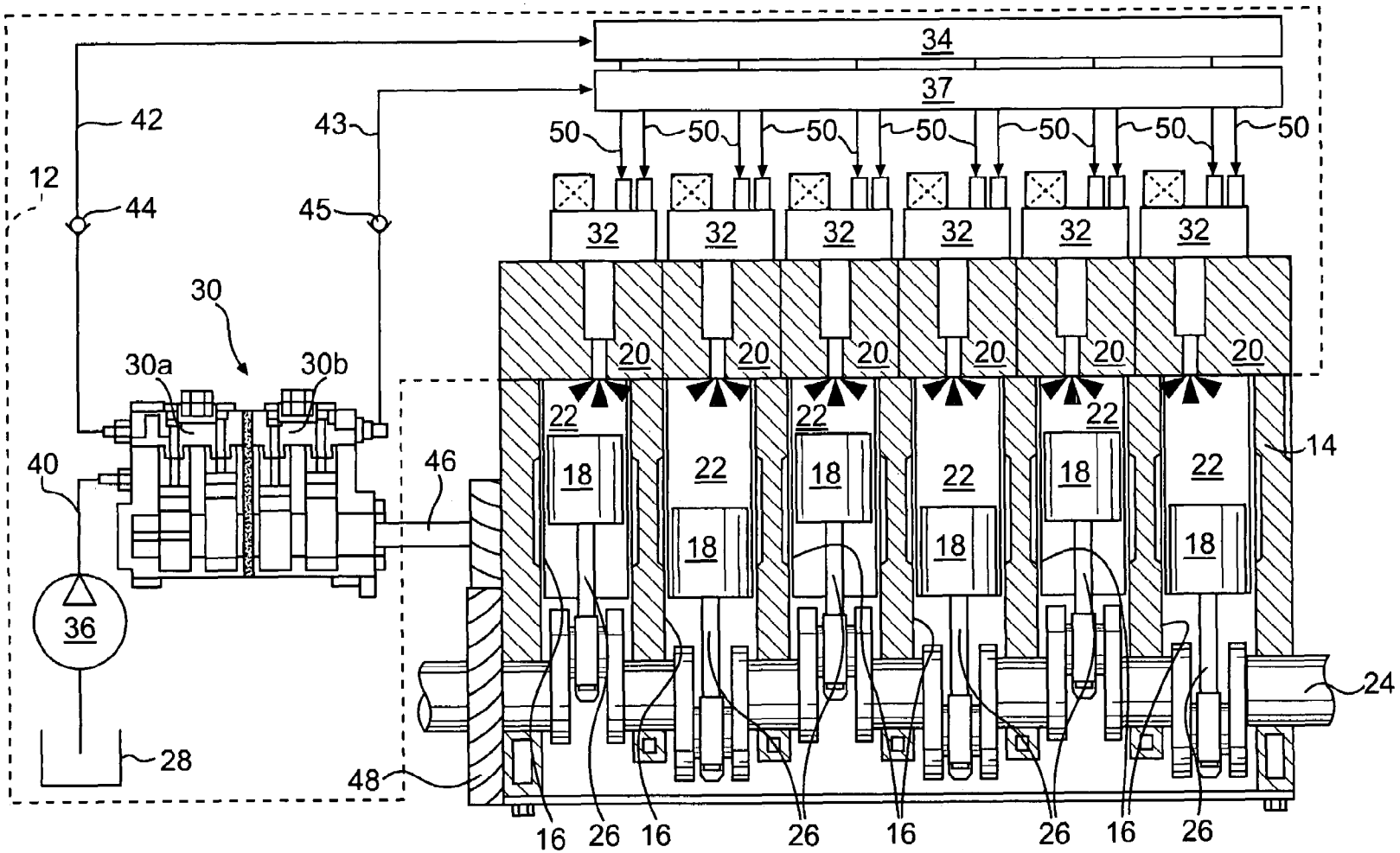
FIG. 1 is a schematic and diagrammatic illustration of an exemplary disclosed engine.

FIG. 1 illustrates an engine 10 having an exemplary embodiment of a fuel system 12. For the purposes of this disclosure, engine 10 is depicted and described as a four-stroke diesel engine. One skilled in the art will recognize, however, that engine 10 may embody any other type of internal combustion engine such as, for example, a gasoline or a gaseous fuel-powered engine. Engine 10 may include an engine block 14 that defines a plurality of cylinders 16, a piston 18 slidably disposed within each cylinder 16, and a cylinder head 20 associated with each cylinder 16.

Cylinder 16, piston 18, and cylinder head 20 may form a combustion chamber 22. In the illustrated embodiment, engine 10 includes six combustion chambers 22. However, it is contemplated that engine 10 may include a greater or lesser number of combustion chambers 22 and that combustion chambers 22 may be disposed in an "in-line" configuration, a "V" configuration, or any other suitable configuration.

As also shown in FIG. 1, engine 10 may include a crankshaft 24 that is rotationally disposed within engine block 14. A connecting rod 26 may connect each piston 18 to crankshaft 24 so that a sliding motion of piston 18 within each respective cylinder 16 results in a rotation of crankshaft 24. Similarly, a rotation of crankshaft 24 may result in a sliding motion of piston 18.

Fuel system 12 may include components that cooperate to deliver injections of pressurized fuel into each combustion chamber 22. Specifically, fuel system 12 may include a tank 28 configured to hold a supply of fuel, and a fuel pumping arrangement 30 configured to pressurize the fuel and direct one or more streams of pressurized fuel to a plurality of fuel injectors 32. A fuel transfer pump 36 may be disposed within a fuel line 40 between the tank 28 and the fuel pumping arrangement 30 and configured to provide low pressure feed to fuel pumping arrangement 30.

Fuel pumping arrangement 30 may embody a mechanically driven, electronically controlled pump having a first pumping mechanism 30*a* and a second pumping mechanism 30*b*. Each of first and second pumping mechanisms 30*a, b* may be operatively connected to a pump drive shaft 46 by way of rotatable cams (not shown). The cams may be adapted to drive piston elements (not shown) of first and second pumping mechanisms 30*a, b* through a compression stroke to pressurize fuel. Plungers (not shown) associated with first and second pumping mechanisms 30*a, b* may be closed at variable timings to change the length of the compression stroke and thereby vary the flow rate of first and second pumping mechanisms 30*a, b*. Alternatively, first and second pumping mechanisms 30*a, b* may include a rotatable swashplate, or any other means known in the art for varying the flow rate of pressurized fuel. It is contemplated that fuel pumping arrangement 30 may alternatively embody two separate pumping elements having fixed output capacities and being disposed in parallel or series relationship, if desired.

First and second pumping mechanisms 30*a, b* may be adapted to generate separate flows of pressurized fuel. For example, first pumping mechanism 30*a* may generate a first flow of pressurized fuel directed to a first common manifold 34 by way of a first fuel supply line 42. Second pumping mechanism 30*b* may generate a second flow of pressurized fuel directed to a second common manifold 37 by way of a second fuel supply line 43. In one example, the first flow of pressurized fuel may have a pressure of about 100 MPa, while the second flow of pressurized fuel may have a pressure of about 200 MPa. A first check valve 44 may be disposed within first fuel supply line 42 to provide for unidirectional flow of fuel from first pumping mechanism 30*a* to first common manifold 34. A second check valve 45 may be disposed within second fuel supply line 43 to provide for unidirectional flow of fuel from second pumping mechanism 30*b* to second common manifold 37.

Fuel pumping arrangement 30 may be operatively connected to engine 10 and driven by crankshaft 24. For example, pump driveshaft 46 of fuel pumping arrangement 30 is shown in FIG. 1 as being connected to crankshaft 24 through a gear train 48. It is contemplated, however, that one or both of first and second pumping mechanisms 30*a, b* may alternatively be driven electrically, hydraulically, pneumatically, or in any other appropriate manner.

Fuel injectors 32 may be disposed within cylinder heads 20 and connected to first and second common manifolds 34, 37 by way of a plurality of fuel lines 50. Each fuel injector 32 may be operable to inject an amount of pressurized fuel into an associated combustion chamber 22 at predetermined timings, fuel pressures, and fuel flow rates. The timing of fuel injection into combustion chamber 22 may be synchronized with the motion of piston 18. For example, fuel may be injected as piston 18 nears a top-dead-center (TDC) position in a compression stroke to allow for compression-ignited-combustion of the injected fuel. Alternatively, fuel may be injected as piston 18 begins the compression stroke heading towards a top-dead-center position for homogenous charge compression ignition operation. Fuel may also be injected as piston 18 is moving from a top-dead-center position towards a bottom-dead-center position during an expansion stroke for a late post injection to create a reducing atmosphere for after-treatment regeneration.

Figure 2:
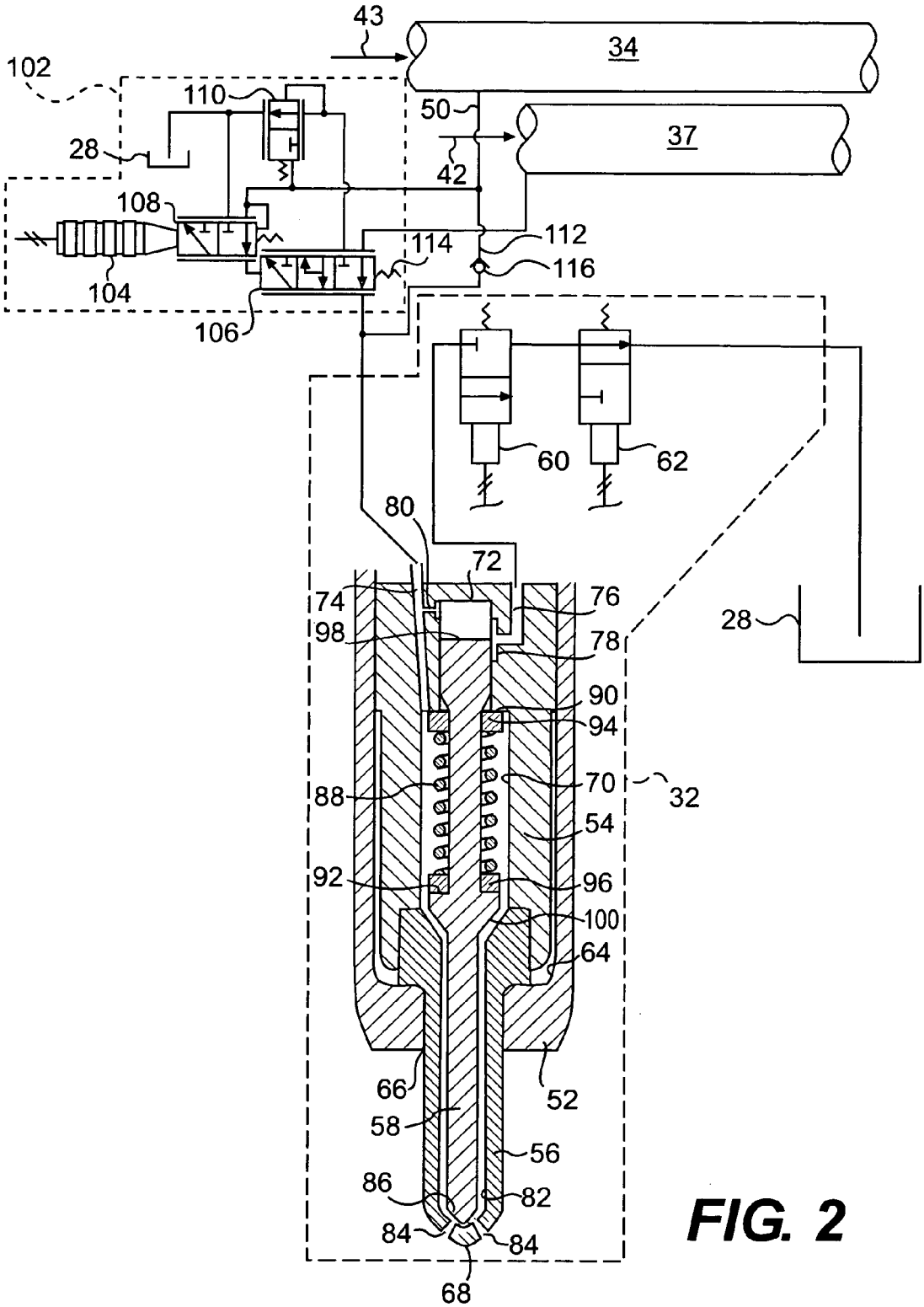
FIG. 2 is a schematic and cross-sectional illustration of an exemplary disclosed fuel system for use with the engine of FIG. 1.

As illustrated in FIG. 2, each fuel injector 32 may embody a closed nozzle unit fuel injector. Specifically, each fuel injector 32 may include an injector body 52 housing a guide 54, a nozzle member 56, a needle valve element 58, a first solenoid actuator 60, and a second solenoid actuator 62.

Injector body 52 may be a generally cylindrical member configured for assembly within cylinder head 20. Injector body 52 may have a central bore 64 for receiving guide 54 and nozzle member 56, and an opening 66 through which a tip end 68 of nozzle member 56 may protrude. A sealing member such as, for example, an o-ring (not shown) may be disposed between guide 54 and nozzle member 56 to restrict fuel leakage from fuel injector 32.

Guide 54 may also be a generally cylindrical member having a central bore 70 configured to receive needle valve element 58, and a control chamber 72. Central bore 70 may act as a pressure chamber, holding pressurized fuel continuously supplied by way of a fuel supply passageway 74. During injection, the pressurized fuel from fuel line 50 may flow through fuel supply passageway 74 and central bore 70 to the tip end 68 of nozzle member 56.

Control chamber 72 may be selectively drained of or supplied with pressurized fuel to control motion of needle valve element 58. Specifically, a control passageway 76 may fluidly connect a port 78 associated with control chamber 72, and first solenoid actuator 60. Port 78 may be disposed within a side wall of control chamber 72 that is radially oriented relative to axial movement of needle valve element 58 or, alternatively, within an axial end portion of control chamber 72. Control chamber 72 may be continuously supplied with pressurized fuel via a restricted supply passageway 80 that is in communication with fuel supply passageway 74. The restriction of supply passageway 80 may allow for a pressure drop within control chamber 72 when control passageway 76 is drained of pressurized fuel.

Nozzle member 56 may likewise embody a generally cylindrical member having a central bore 82 that is configured to receive needle valve element 58. Nozzle member 56 may further include one or more orifices 84 to allow injection of the pressurized fuel from central bore 82 into combustion chambers 22 of engine 10.

Needle valve element 58 may be a generally elongated cylindrical member that is slidingly disposed within housing guide 54 and nozzle member 56. Needle valve element 58 may be axially movable between a first position at which a tip end 86 of needle valve element 58 blocks a flow of fuel through orifices 84, and a second position at which orifices 84 are open to allow a flow of pressurized fuel into combustion chamber 22.

Needle valve element 58 may be normally biased toward the first position. In particular, each fuel injector 32 may include a spring 88 disposed between a stop 90 of guide 54 and a seating surface 92 of needle valve element 58 to axially bias tip end 86 toward the orifice-blocking position. A first spacer 94 may be disposed between spring 88 and stop 90, and a second spacer 96 may be disposed between spring 88 and seating surface 92 to reduce wear of the components within fuel injector 32.

Needle valve element 58 may have multiple driving hydraulic surfaces. In particular, needle valve element 58 may include a hydraulic surface 98 tending to drive needle valve element 58 toward the first or orifice-blocking position when acted upon by pressurized fuel, and a hydraulic surface 100 that tends to oppose the bias of spring 88 and drive needle valve element 58 in the opposite direction toward the second or orifice-opening position.

First solenoid actuator 60 may be disposed opposite tip end 86 of needle valve element 58 to control the opening motion of needle valve element 58. In particular, first solenoid actuator 60 may include a two-position valve element disposed between control chamber 72 and tank 28. The valve element may be spring-biased toward a closed position blocking fluid flow from control chamber 72 to tank 28, and solenoid-actuated toward an open position at which fuel is allowed to flow from control chamber 72 to tank 28. The valve element may be movable between the closed and open positions in response to an electric current applied to a coil associated with first solenoid actuator 60. It is contemplated that the valve element may alternatively be hydraulically operated, mechanically operated, pneumatically operated, or operated in any other suitable manner. It is further contemplated that the valve element may alternatively embody a proportional type of valve element that is movable to any position between the closed and open positions.

Second solenoid actuator 62 may include a two-position valve element disposed between first solenoid actuator 60 and tank 28 to control a closing motion of needle valve element 58. The valve element may be spring-biased toward an open position at which fuel is allowed to flow to tank 28, and solenoid-actuated toward a closed position blocking fluid flow to tank 28. The valve element may be movable between the open and closed positions in response to an electric current applied to a coil associated with second solenoid actuator 62. It is contemplated that the valve element may alternatively be hydraulically operated, mechanically operated, pneumatically operated, or operated in any other suitable manner. It is further contemplated that the valve element may alternatively embody a three-position type of valve element, wherein bidirectional flows of pressurized fuel are facilitated.

As also illustrated in FIG. 2, a pressure control valve 102 may be associated with each fuel injector 32. Specifically, pressure control valve 102 may include a first valve element 106, a second valve element 108, an actuator 104 connected to move valve element 108, a third valve element 110, and a bypass circuit 112. In response to the fuel pressures within first and second common manifolds 34, 37, and a current input to actuator 104, pressure control valve 102 may regulate the pressure of fuel directed through fuel supply passageway 74 to fuel injector 32. It is contemplated that pressure control valve 102 may be part of fuel injector 32 or a separate stand-alone component associated with one or more fuel injectors 32.

Valve element 106 may embody a pilot-operated proportional valve element or other suitable device movable by fluid pressure acting at an end thereof to selectively pass a portion of the pressurized fuel from second common manifold 37 to central bore 82 of nozzle member 56. Specifically, valve element 106 may be movable from a first position at which a maximum amount of the first stream of pressurized fuel is directed to central bore 82, against the bias of a return spring 114 toward a second position at which no pressurized fuel from second common manifold 37 flows to central bore 82. Valve element 106 may also be movable to any position between the first and second positions to direct a portion of the maximum amount to tank 28 and the remaining portion of the maximum amount to central bore 82. The amount and ratio of the fuel directed by valve element 106 to central bore 82 and tank 28 may depend on the pressure of fluid acting on the end of valve element 106 and may affect the pressure of the fuel supplied to central bore 82. For example, as the fuel amount draining through valve element 106 to tank 28 increases (e.g., valve element 106 is moved toward, but not all the way to the second position), the pressure of the fuel directed to central bore 82 may decrease. Conversely, as the amount of the first fuel flow draining through valve element 106 to tank 28 decreases (e.g., valve element 106 is moved toward the first position), the pressure of the fuel directed to central bore 82 may increase. In this manner, variable injection pressures through orifices 84 and penetration depth into combustion chamber 22 may be attained.

Valve element 108 may also embody a proportional valve element or other suitable device and may be movable to affect the location of valve element 106 between the first and second positions. Specifically, valve element 108 may be movable between a first position at which pressurized pilot fuel from first common manifold 34 is communicated with the end of valve element 106, and a second position at which the pressurized pilot fuel at the end of valve element 106 is drained to tank 28. The speed at which the pilot fuel is drained or communicated with the end of valve element 106 may affect the rate at which the fuel pressure within fuel injector 32 changes. Fuel from upstream of valve element 108 may cooperate with the bias of an associated return spring to retain valve element 108 in contact with actuator 40.

Actuator 104 may embody a piezo electric mechanism having one or more columns of piezo electric crystals. Piezo electric crystals are structures with random domain orientations. These random orientations are asymmetric arrangements of positive and negative ions that exhibit permanent dipole behavior. When an electric field is applied to the crystals, such as, for example, by the application of a current, the piezo electric crystals expand along the axis of the electric field as the domains line up. Actuator 104 may be mechanically connected to move valve element 108 between the first and second positions in response to an applied current.

Valve element 110 may embody a pressure regulating valve element configured to affect the pressure of fuel flowing through valve element 106 to fuel injector 32. In particular, valve element 110 may be disposed between valve element 106 and tank 28, such that as valve element 106 is moved away from the first position, some fuel is passed through valve element 106 to valve element 110. A first end of valve element 110 may be in communication with fuel from first common manifold 34 and, together with the bias of a return spring, urge valve element 110 toward a flow blocking position. When in the flow blocking position, substantially no fuel may passed through valve element 110 to tank 28. A second end of valve element 110 may be in communication with the fuel passed through valve element 106 and may urge valve element 110 toward a flow passing position. When in the flow passing position, the amount of fuel allowed to drain to tank 28 may be dependent on the amount of fuel passed through valve element 106, the resulting pressure of the passed fuel, and the pressure of the fuel from first common manifold 34 supplied to the opposing end of valve element 110. In this manner, the pressure of the fuel within first common manifold 34 may affect the pressure of the fuel from first common manifold 37 passed to fuel injector 32.

Bypass circuit 112 may ensure a minimum pressure of fuel is always available to fuel injector 32. In particular, when valve element 106 is in the second position the only source of fuel for injector 32 may be first common manifold 34 by way of bypass circuit 112. Bypass circuit 112 may include a check valve 116 that ensures unidirectional flow of fuel through bypass circuit 112 such that fuel flows through bypass circuit 112 only when a fuel pressure within injector 32 drops below fuel pressure within first common manifold 34.

INDUSTRIAL APPLICABILITY

The fuel system of the present disclosure has wide application in a variety of engine types including, for example, diesel engines, gasoline engines, and gaseous fuel-powered engines. The disclosed fuel system may be implemented into any engine that utilizes a pressurizing fuel system wherein it may be advantageous to provide a variable pressure supply of fuel. The operation of fuel system 12 will now be explained.

Needle valve element 58 may be moved by an imbalance of force generated by fuel pressure. For example, when needle valve element 58 is in the first or orifice-blocking position, pressurized fuel from fuel supply passageway 74 may flow into control chamber 72 to act on hydraulic surface 98. Simultaneously, pressurized fuel from fuel supply passageway 74 may flow into central bores 70 and 82 in anticipation of injection. The force of spring 88 combined with the hydraulic force generated at hydraulic surface 98 may be greater than an opposing force generated at hydraulic surface 100 thereby causing needle valve element 58 to remain in the first position to restrict fuel flow through orifices 84. To open orifices 84 and inject the pressurized fuel from central bore 82 into combustion chamber 22, first solenoid actuator 60 may move its associated valve element to selectively drain the pressurized fuel away from control chamber 72 and hydraulic surface 98. This decrease in pressure acting on hydraulic surface 98 may allow the opposing force acting across hydraulic surface 100 to overcome the biasing force of spring 88, thereby moving needle valve element 58 toward the orifice-opening position.

To close orifices 84 and end the injection of fuel into combustion chamber 22, second solenoid actuator 62 may be energized. In particular, as the valve element associated with second solenoid actuator 62 is urged toward the flow blocking position, fluid from control chamber 72 may be prevented from draining to tank 28. Because pressurized fluid is continuously supplied to control chamber 72 via restricted supply passageway 80, pressure may rapidly build within control chamber 72 when drainage through control passageway 76 is prevented. The increasing pressure within control chamber 72, combined with the biasing force of spring 88, may overcome the opposing force acting on hydraulic surface 100 to force needle valve element 58 toward the closed position. It is contemplated that second solenoid actuator 62 may be omitted, if desired, and first solenoid actuator 60 used to initiate both the opening and closing motions of needle valve element 58.

Pressure control valve 102 may affect the pressure of fuel supplied to central bores 70 and 82 and subsequently injected into combustion chamber 22. Specifically, in response to a current applied to the piezo electric crystals of actuator 104, actuator 104 may move valve element 108 to drain pressurized fuel from the end of valve element 106, allowing valve element 106 to move toward its first position and decrease the amount of pressurized fuel draining from second common manifold 37 to tank 28. The decreased amount of fuel draining to tank 28 may result in an increase in pressure within fuel injector 32. In contrast, as current is removed from actuator 104, valve element 108 may move to communicate pressurized fuel from first common manifold 34 with the end of valve element 106, thereby urging valve element 106 toward its second position to increase the amount of pressurized fuel draining from second common manifold 37 to tank 28. The increased amount of fuel draining to tank 28 may act to lower the pressure of the fuel supplied to fuel injector 32.

As the draining fuel reaches valve element 110, it may continue toward drain 28 or may be blocked in response to a pressure differential across valve element 110. Specifically, if the force on valve element 110 resulting from the pressure of the fuel draining through valve element 106 is greater than the force resulting from the pressure of fuel within first common manifold 34 and the bias of the associated return spring, valve element 110 may open to pass the draining fuel to tank 28. However, if the force resulting from the fuel draining through valve element 106 is less than the force resulting from the pressure of the fuel within first common manifold 34 and the bias of the return spring, the draining fuel may be blocked from tank 28. In this manner, the pressure of the fuel within first common manifold 34 may affect the pressure of the fuel directed to fuel injector 32.

Fuel may always be available to injector 32, regardless of the operation of pressure control valve 102. In particular, bypass circuit 112 may ensure that any time the fuel pressure within fuel injector 32 falls below the pressure of the fuel within first common manifold 34, the fuel within first common manifold 34 is allowed to flow to injector 32.

Fuel system 12 may provide an infinite range of injection pressures. In particular, because the pressure of the injected fuel may vary in response to a position of valve element 106, and because valve element 106 may be moved to any position between its first and second position, many different pressures may available for injection. In addition, because fuel system 12 may utilize only fuel to affect these pressure changes, contamination between dissimilar fluids is not an issue.

It will be apparent to those skilled in the art that various modifications and variations can be made to the fuel system of the present disclosure without departing from the scope of the disclosure. Other embodiments will be apparent to those skilled in the art from consideration of the specification and practice of the fuel system disclosed herein. It is intended that the specification and examples be considered as exemplary only, with a true scope of the invention being indicated by the following claims and their equivalents.

What is claimed is:

1. A fuel system for an engine, comprising:

a first source configured to pressurize fuel to a first pressure;

a second source configured to pressurize fuel to a second pressure;

a fuel injector configured to receive fuel at the first pressure and the second pressure; and a valve disposed between the fuel injector and the first and second sources, the valve being configured to modify the pressure of fuel from the first source by selectively passing a portion of the fuel from the first source to a drain based on a pressure of fuel from the second source.

2. The fuel system of claim 1, wherein the valve is further configured to selectively pass fuel from only the first source to the fuel injector.

3. The fuel system of claim 1, wherein the valve includes:

a first valve element disposed between the first source and the fuel injector, the first valve element movable between a first position at which the fuel from the first source is directed to only the fuel injector, and a second position at which a portion of the fuel from the first source is directed to a drain; and a second valve element disposed between the second source and an end of the first valve element, the second valve element movable between a first position at which fuel from the second source is directed to the end of the first valve element to bias the first valve element toward its second position, and a second position at which fuel from the end of the first valve element is directed to a drain.

4. The fuel system of claim 3, further including a third valve element disposed between the second source and the first valve element, the third valve element movable between a first position at which fuel from the first source is passed to a drain and a second position at which fuel from the first source is blocked from the drain, wherein the movement is in response to a pressure differential between the fuel from second source and the fuel from the first source.

5. The fuel system of claim 4, wherein the fuel from the first source is at a higher pressure than the fuel from the second source.

6. The fuel system of claim 5, wherein modifying includes only lowering the pressure of the fuel from the first fuel source.

7. The fuel system of claim 3, further including a piezo device configured to move the second valve element between the first and second positions.

8. The fuel system of claim 1, further including a bypass circuit configured to pass fuel from the second source to fuel injector.

9. A method of injecting fuel, the method comprising:

pressurizing a first fuel stream;

pressurizing a second fuel stream;

modifying the pressure of the first fuel stream by selectively draining a portion of the first fuel stream based on a pressure of the second fuel stream; and injecting the first fuel stream at the modified pressure.

10. The method of claim 9, further including selectively injecting only the first fuel stream and only the second fuel stream.

11. The method of claim 9, wherein selectively draining a portion of the first fuel stream lowers the pressure of the first fuel stream.

12. The method of claim 9, wherein the first fuel stream is pressurized to a higher pressure than the second fuel stream.

13. An engine, comprising:

a block forming at least one combustion chamber;

a crankshaft rotationally disposed within the block;

a first fuel pump operatively driven by the crankshaft to pressurize fuel to a first pressure;

a second fuel pump operatively driven by the crankshaft to pressurize fuel to a second pressure lower than the first;

a fuel injector configured to receive the fuel from the first and second fuel pumps and selectively inject the fuel into the at least one combustion chamber; and a valve disposed between the fuel injector and the first and second fuel pumps, the valve being configured to:

lower the pressure of fuel from the first fuel pump based on the pressure of fuel from the second fuel pump; and selectively pass fuel from only the first source to the fuel injector.

14. The engine of claim 13, wherein:

the valve lowers the pressure of the fuel from the first source by selectively passing a portion of the fuel from the first source to a drain; and the portion of the fuel from the first source selectively passed to the drain is dependent on a pressure of the fuel from the second source.

15. The engine of claim 13, wherein the valve includes:

a first valve element disposed between the first source and the fuel injector, the first valve element movable between a first position at which the fuel from the first source is directed to only the fuel injector, and a second position at which a portion of the fuel from the first source is directed to a drain; and a second valve element disposed between the second source and an end of the first valve element, the second valve element movable between a first position at which fuel from the second source is directed to the end of the first valve element to bias the first valve element toward its second position, and a second position at which fuel from the end of the first valve element is directed to a drain.

16. The engine of claim 15, further including a third valve element disposed between the second source and the first valve element, the third valve element movable between a first position at which fuel from the first source is passed to a drain and a second position at which fuel from the first source is blocked from the drain, wherein the movement is in response to a pressure differential between the fuel from second source and the fuel from the first source.

17. The engine of claim 15, further including a piezo device configured to move the second valve element between the first and second positions.

* * * * *